US006648637B2

(12) United States Patent
Quigley

(10) Patent No.: US 6,648,637 B2
(45) Date of Patent: Nov. 18, 2003

(54) SEAL AND SEALING METHOD FOR TEMPERATURE CONTROL CHAMBER DOORS

(75) Inventor: John Patrick Quigley, Watertown, WI (US)

(73) Assignee: General Signal Technology Corporation, Charlotte, NC (US)

( * ) Notice: Subject to any disclaimer, the term of this patent is extended or adjusted under 35 U.S.C. 154(b) by 26 days.

(21) Appl. No.: 09/993,490

(22) Filed: Nov. 27, 2001

(65) Prior Publication Data

US 2003/0099915 A1 May 29, 2003

(51) Int. Cl.[7] ..... F27D 1/18

(52) U.S. Cl. ..... 432/242; 432/237; 432/250; 52/273; 49/489.1

(58) Field of Search ..... 432/115, 237, 432/244, 250, 242; 110/173 R, 180, 181; 52/85, 211, 273; 49/50, 489.1

(56) References Cited

U.S. PATENT DOCUMENTS

| | | | | | |
|---|---|---|---|---|---|
| 3,603,035 | A | * | 9/1971 | Kaldenberg | 49/489.1 |
| 3,797,172 | A | * | 3/1974 | Cannon | 49/463 |
| 4,312,153 | A | * | 1/1982 | Parkinson et al. | 49/496.1 |
| 4,961,588 | A | * | 10/1990 | Brienza | 277/545 |
| 5,465,532 | A | * | 11/1995 | Varin | 49/493.1 |
| 5,571,269 | A | * | 11/1996 | Buelow | 277/545 |

* cited by examiner

*Primary Examiner*—Gregory Wilson
(74) *Attorney, Agent, or Firm*—Baker & Hostetler

(57) ABSTRACT

A system for sealing a lower edge of a temperature control chamber door to a temperature control chamber housing when the door is closed has a pair of opposed radiused corners provided at opposed lower corners of the door opening, and a resilient seal member having opposed radiused corners substantially complimentary in shape to the radiused corners of the opening.

15 Claims, 4 Drawing Sheets

SEAL AND SEALING METHOD FOR TEMPERATURE CONTROL CHAMBER DOORS

FIELD OF THE INVENTION

The invention pertains generally to seals for sealing oven doors when they are closed. More particularly, the invention pertains to a seal and sealing method for sealing the lower end of an oven door, such as for example an industrial oven.

BACKGROUND OF THE INVENTION

Many types of commercial and other ovens are in use today, particularly in industrial applications such as baking various parts or components. Such ovens typically operate to 350 degrees C., or at greater temperatures. One type of industrial oven has a front opening with a door and shelves or other mounting areas inside the oven so that the items to be treated may be placed within the oven. In these types of ovens, it is possible for a gasket to follow inside the periphery of the door, and the door opening is generally surrounded by housing on all sides that has enough overlapping area with the door to accept contact with the gasket.

However, in another type of oven, it is desirable to place the items on a rolling cart and wheel the cart through the oven door into the oven and then close the door while the oven operates. It has been known for these ovens to have straight vertical sides extending upwardly from the floor, providing an opening with the same. These types of ovens commonly have a relatively thin bottom wall in order to permit the cart to be rolled through the door, and the door opening thus has a very thin bottom surface. This presents a problem in that the sealing gasket which is generally mounted on the inside of the door does not have enough overlapping area to seal with the thin bottom floor wall of the oven.

One solution to this problem has been to provide a flexible flap extending downwardly from the oven door which contacts with the oven floor when the oven is closed. However, because the door openings generally have squared off 90 degree corners at the bottoms where the floor and side walls meet, these lower door flaps have been provided with straight vertical ends. Due to the vertical ends and squared off 90 degree corners, a clearance or gap is necessary to be provided between the vertical ends of the flaps and the vertical interior edges of the door opening, so that the squared off flap does not bind when the door is closed.

The needed clearance can be large enough so that the performance of the oven is adversely affected in some way. For example, the gap which must be provided in the prior art squared off flaps can release heat, and such heat loss can lead to a waste of energy and/or undesirable heat emissions. The gap can also lead to emission of undesirable odors from the inside of the oven. Moreover, because a gap must be intentionally provided, the lower flap cannot provide any pressure sealing ability.

Accordingly, there is a need in the art for a seal that can be used to seal the bottom of an oven having a relatively thin floor which can provide a good seal without binding when the door is closed.

SUMMARY OF THE INVENTION

The present invention provides a seal that can be used to seal the bottom of an oven having a relatively thin floor which can provide a good seal without binding when the door is closed.

In one aspect, the invention provides a system for sealing a lower edge of an oven door to an oven housing when the door is closed, the system comprising: a pair of opposed radiused corners provided at opposed lower corners of the door opening; and a resilient seal member having opposed radiused corners substantially complimentary in shape to the radiused corners of the opening.

In another aspect, the invention provides a system for sealing a lower edge of an oven door to an oven housing when the door is closed, the system comprising: a pair of opposed radiused corners provided at opposed lower corners of the door opening; and sealing means for sealing the door to the housing having opposed radiused corners substantially complimentary in shape to the radiused corners of the opening.

In another aspect, the invention provides a method for sealing a lower edge of an oven door to an oven housing when the door is closed, the method comprising the steps of: providing a pair of opposed radiused corners provided at opposed lower corners of the door opening; and sealing the door to the housing using a seal having opposed radiused corners substantially complimentary in shape to the radiused corners of the opening.

In some embodiments, the radiused corners follow a circular radius shape. In other embodiments, the radiused corners follow an arcuate shape. In still other embodiments, the radiused corners follow a non-circular curved shape.

In some embodiments, the system comprises an angle support bracket mounted to a lower edge of the door that supports an upper portion of the flexible seal against deflection when the door is closed.

Also in some embodiments, the radiused corners of the seal have an interference with the radiused corners of the oven when the door is closed. In some embodiments the seal has an S-shaped cross-section, defining a lower portion, a central portion, and an upper portion, and wherein the lower portion has the radiused corners, and wherein the upper portion extends to a width that is wider than the lower portion. In these and other embodiments, the upper portion seals against an inner surface of the door and also seals against a lower surface of a door gasket, wherein the door has a door gasket extending around the periphery of the door on the inside surface of the door.

Although an oven is given as an example, the present invention may be suitable for any temperature control chamber such as a refrigerator.

There has thus been outlined, rather broadly, the more important features of the invention in order that the detailed description thereof that follows may be better understood and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENTS OF THE INVENTION

Figure 1:
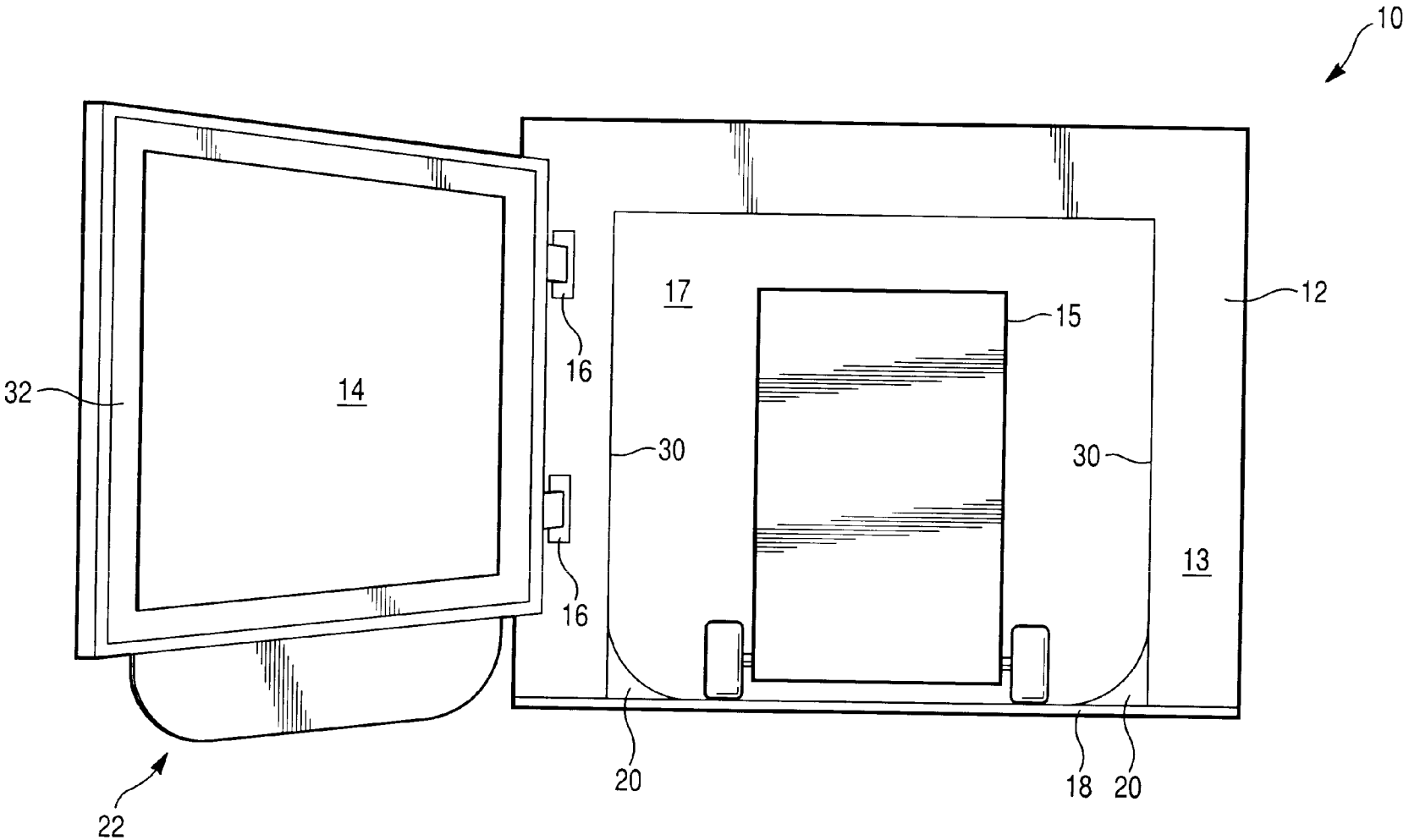
FIG. 1 is a front view of an oven according to a preferred embodiment of the present invention with the door open.

FIG. 1 illustrates an oven 10 according to the preferred embodiment of the invention, having an outer housing 12 with a front surface 13 as shown. A door 14 swings open to permit entry and exit of a rolling cart 15. The door 14 is supported on the housing 12 by hinges 16. A door opening 17 is defined on the top and sides by an edge 30 of the housing 13.

The opening 17 is defined on the bottom by a relatively thin metal floor 18 as shown. The floor 18 is generally made of relatively thin material so that it has a low height, to facilitate rolling of the cart 15 onto the floor 18. In some exemplary preferred embodiments, the steel floor plate may be a quarter inch thick, and the lower edge of the door may rise approximately 2 inches off the ground.

Figure 2:
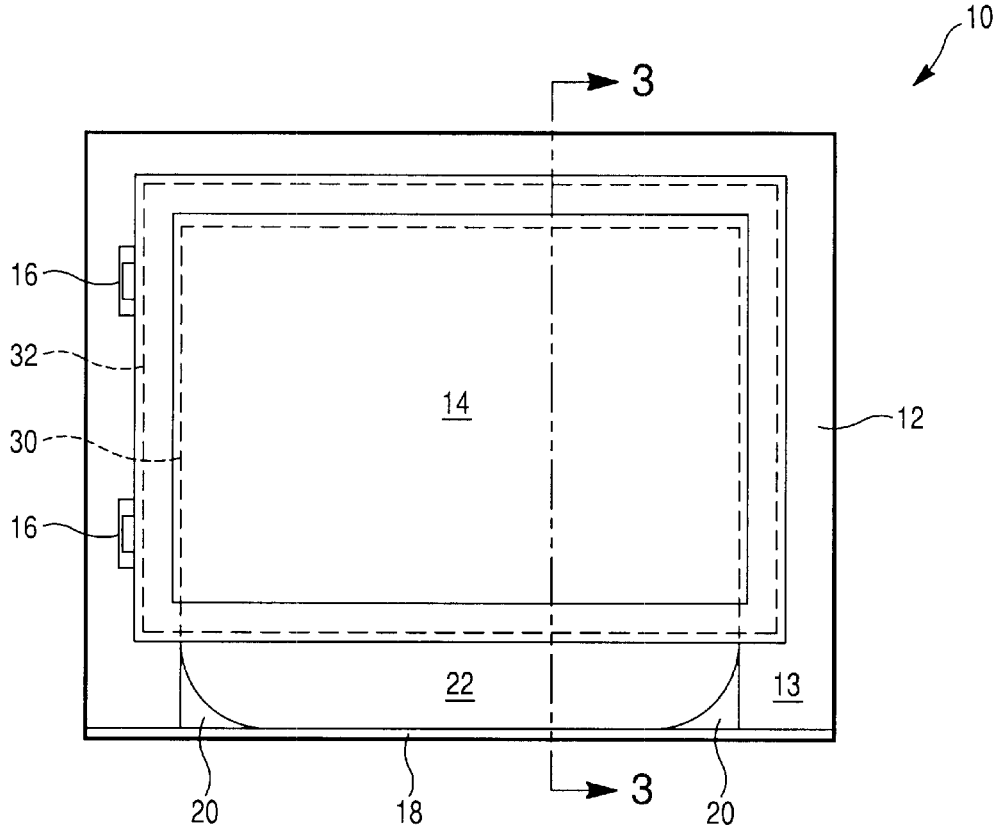
FIG. 2 is a front view of an oven according FIG. 1 with the door closed.

In the preferred embodiment, a pair of radiused corner pieces 20 are provided as shown. The door 14 is provided on its inside surface with a gasket 32 that is attached to the inside of the door and runs generally adjacent the periphery of the door 14. It will be appreciated that in the embodiment shown, when the door is closed as depicted in FIG. 2, the top and sides of the gasket 32 are pressed into contact with the front surface 13 of the housing 12, and thus seal around the top and both sides of the door 14. However, the bottom portion of the gasket 32 spans across the opening between the two side walls 30, and thus does not provide a seal for the lower part of the door.

In the preferred embodiment of the invention, sealing for the door is provided by a flap 22 which is shaped to interact with the corners 20 as shown. Specifically, referring to FIG. 3, flap 22 includes a preferably silicone flexible seal 24 which is roughly S-shaped as shown in FIG. 4 and includes a lower portion 25, a central portion 27 and an upper portion 29. As shown in more detail in FIGS. 6 and 7, the flexible silicone seal 24 is affixed to an angle iron shaped bracket 26. Fasteners such as a screw, or glue point are indicated at item 36. The bracket 26 is in turn fixed to the lower edge of the door 14 by another fastener such as the screw, weld or glue as indicated at 34.

The corner pieces 20 may be held in place in their respective corners by any suitable means, and may be made preferably of aluminum, steel or other suitable material. To facilitate installation of the corner pieces in the corner formed by the vertical edges of the housing 12 and the floor element 18, it can be preferable to provide a relief 38 in the corner piece 20 which may be sealed with metal or epoxy after the corner piece 20 has been installed.

Figure 3:
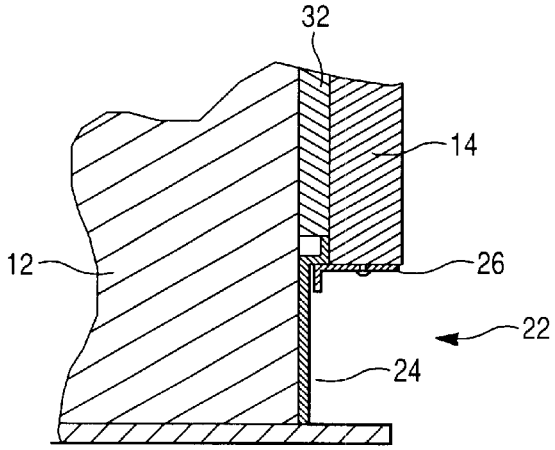
FIG. 3 is a cross-sectional view taken through line 3—3 in FIG. 2.
Figure 4:
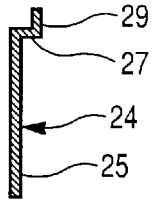
FIG. 4 is a side view of a seal element according to a preferred embodiment of the invention.

A cross section of the arrangement of the silicone flap 24 is seen in FIG. 3. It will be appreciated that the upper part 29 of the silicone flap 24 abuts against an inside surface of the door 14, and extends upwardly to the lower edge of the gasket 32 which is spanning across the open portion of the door opening 17. Thus, as seen in FIG. 3 when the door 14 is closed the seal 24 provides a suitable seal together with the gasket 32.

Figure 6:
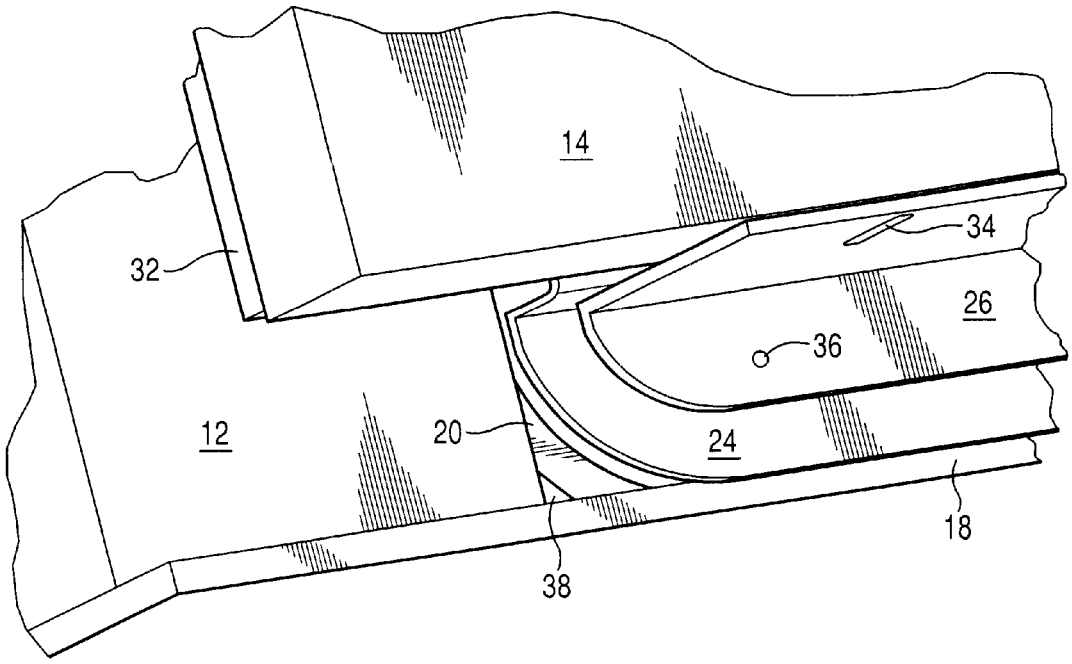
FIG. 6 is a perspective view showing the seal prior to full closing of the door.
Figure 7:
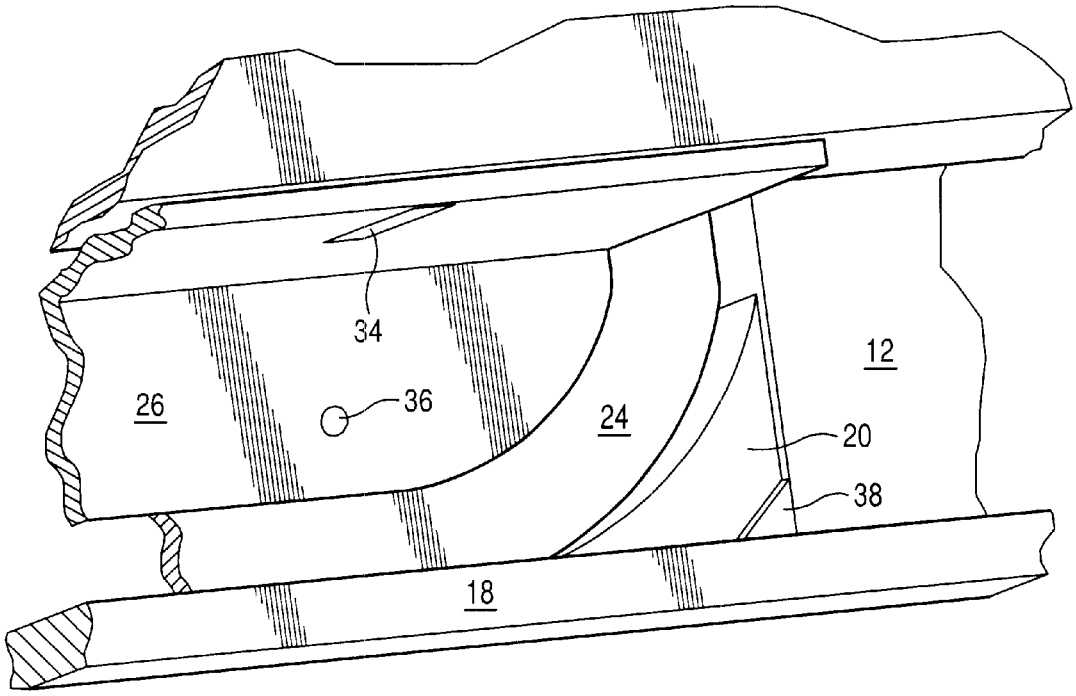
FIG. 7 is a perspective view showing the seal upon fall closing of the door.

The operation of the silicone seal 24 can be seen particularly in FIG. 6 and FIG. 7. FIG. 6 shows a left corner of the door partially prior to the door being fully closed. FIG. 7 shows the right corner positioning of the seal after the door has been fully closed. As best seen in FIG. 7, the seal 24 is dimensioned so that when the door is fully closed the seal has extended inwardly just past the front vertical plane of the floor 18 by corner piece 20, and housing 12. The seal 24 is shaped slightly larger than the opening to which it sits, so that the seal 24 has some degree of interference when the door is closed.

The curved nature of the seal corners, which are shaped to be complimentary with the curve of the corner piece 20, permits the seal 24 to have this interference causing it to deform slightly providing a suitably tight resilient seal. This is a significant improvement over having a right angle corner through the seal, where interference causes undesirable binding and a failure to fit snugly.

The curved corners provide a significant advantage of the invention, whereby the seal 24 can fit resiliently against the housing 12, corner piece 20, and floor 18. By virtue of this, the curved corners provide desirable temperature insulation, which can save power consumption. This feature can also provide more steady and even temperature control, and reduce undesirable heat emissions. Moreover, the slightly resilient fit provides some resistance to air escaping due to pressure increases inside the oven, due to heat or an internal fan if present, and this can further enhance the aforementioned installed properties of the device.

Figure 5:
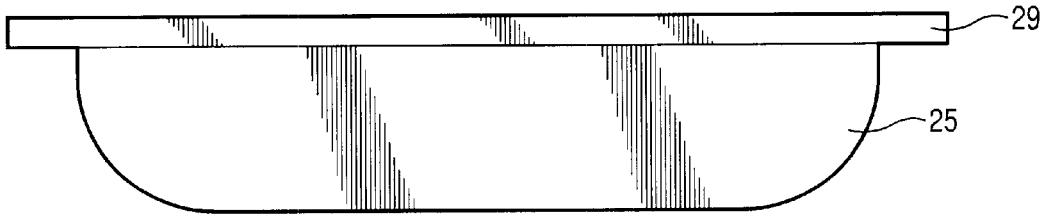
FIG. 5 is a front view of the seal element shown in FIG. 4.

As described above, the upper end 29 of the silicone seal 24 is attached to the inside of the door 14, and abuts against the lower edge of the gasket 32. In a preferred embodiment, it is desirable for the upper end 29 to be elongated slightly as shown in FIG. 5. FIG. 5 shows that the upper portion 29 extends outwardly at the lateral portions to form a pair of ears. In this way, the upper portion 29 can be sized so that it extends the entire width of the door gasket 32. This feature enhances the overall sealing ability of the seal 22.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A system for sealing a lower edge of temperature control chamber door to a temperature control chamber housing when the door is closed, the system comprising:

a pair of opposed radiused corners provided at opposed lower corners of the door opening of the temperature control chamber; and a resilient seal member mounted to the door and having opposed radiused corners substantially complimentary in shape to the radiused corners of the door opening of the temperature control chamber;

wherein the seal has an S-shaped cross-section, defining a lower portion, a central portion, and an upper portion, and wherein the lower portion has the radiused corners, and wherein the upper portion extends to a width that is wider than the lower portion.

2. A system according to claim 1, wherein the radiused corners follow a circular radius shape.

3. A system according to claim 1, wherein the radiused corners follows an arcuate shape.

4. A system according to claim 1, further comprising angle support bracket mounted to a lower edge of the door that supports an upper portion of the flexible seal against deflection when the door is closed.

5. A system according to claim 1, wherein the radiused corners of the seal have an interference with the radiused lower corners of the door opening of the temperature control chamber when the door is closed.

6. A system according to claim 1, wherein the upper portion seals against an inner surface of the door and also seals against a lower surface of a door gasket, wherein the door has a door gasket extending around the periphery of the door on the inside surface of the door.

7. A system for sealing a lower edge of a temperature control chamber door to a temperature control chamber housing when the door is closed, the system comprising:

a pair of opposed radiused corners provided at opposed lower corners of the door opening of the temperature control chamber;

sealing means mounted to the door for sealing the door to the housing having opposed radiused corners substantially complimentary in shape to the radiused corners of the door opening of the temperature control chamber; and wherein the sealing means has an S-shaped cross-section, defining a lower portion, a central portion, and an upper portion, and wherein the lower portion as the radiused corners, and wherein the upper portion extends to a width that is wider than the lower portion.

8. A system according to claim 7, wherein the radiused corners follow a circular radius shape.

9. A system according to claim 7, wherein the radiused corners follow an arcuate shape.

10. A system according to claim 7, further comprising angle support bracket mounted to a lower edge of the door that supports an upper portion of the sealing means against deflection when the door is closed.

11. A system according to claim 7, wherein the radiused corners of the sealing means have an interference with the radiused corners of the temperature control chamber when the door is closed.

12. A system according to claim 7, wherein the upper portion seals against an inner surface of the door and also seals against a lower surface of a door gasket, wherein the door has a door gasket extending around the periphery of the door on the inside surface of the door.

13. A method for sealing a lower edge of a temperature control chamber door to a temperature control chamber housing when the door is closed, the method comprising the steps of:

providing a pair of opposed radiused corners provided at opposed lower corners of the door opening of the temperature control chamber; and sealing the door to the housing using a seal mounted to the door and having opposed radiused corners substantially complimentary in shape to the radiused corners of the door opening of the temperature control chamber, wherein the seal has an S-shaped cross-section, defining a lower portion, a central portion, and an upper portion, and wherein the lower portion has the radiused corners, and wherein the upper portion extends to a width that is wider than the lower portion.

14. A system according to claim 13, wherein the radiused corners follow a circular radius shape.

15. A system according to claim 13, wherein the radiused corners follow an arcuate shape.

* * * * *